US006119618A

United States Patent [19]

Giles

[11] Patent Number: 6,119,618

[45] Date of Patent: Sep. 19, 2000

[54] SPRING BIASED MODULAR BOAT ANCHOR AND KIT

[76] Inventor: Richard Giles, 67 S. 300 East, Springville, Utah 84663

[21] Appl. No.: 09/223,468

[22] Filed: Dec. 30, 1998

Related U.S. Application Data

[63] Continuation-in-part of application No. 09/198,739, Nov. 24, 1998, Pat. No. 6,038,996.

[51] Int. Cl.[7] ..... B63B 21/24

[52] U.S. Cl. ..... 114/297; 114/303; 114/304

[58] Field of Search ..... 114/294, 297, 114/298, 301, 303, 304, 309, 310

[56] References Cited

U.S. PATENT DOCUMENTS

| | | | |
|---|---|---|---|
| 2,948,249 | 8/1960 | Gesner et al. | 114/208 |
| 3,280,783 | 10/1966 | Menning | 114/303 |
| 3,306,248 | 2/1967 | Austin | 114/208 |
| 3,518,957 | 7/1970 | George | 114/297 |
| 3,759,212 | 9/1973 | Cluett | 114/208 |
| 3,766,877 | 10/1973 | Beck | 114/208 |
| 3,771,486 | 11/1973 | Hungerford | 114/208 |
| 3,780,688 | 12/1973 | Hungerford | 114/208 |
| 3,964,420 | 6/1976 | Stelling | 114/208 |
| 4,058,078 | 11/1977 | Stelling | 114/303 |
| 4,250,828 | 2/1981 | Cota | 114/307 |
| 4,380,207 | 4/1983 | Nolt | 114/297 |
| 4,700,652 | 10/1987 | Pekny | 114/303 |
| 4,763,597 | 8/1988 | Stupakis | 114/297 |
| 4,827,863 | 5/1989 | Scholz et al. | 114/304 |
| 4,892,053 | 1/1990 | Hallerberg | 114/303 |
| 4,958,586 | 9/1990 | Stupakis | 114/297 |
| 5,054,416 | 10/1991 | Zetah | 114/304 |
| 5,154,133 | 10/1992 | Hallerberg | 114/303 |

OTHER PUBLICATIONS

Pivot Point, Pivot Point Catalog: Non–Threaded Fastener Solutions, pp. 24–25 Aug. 1997.

E. Sullivan, The Marine Encyclopaedia Dictionary, pp. 22–25, 1996.

Captain T. Lenfestey, Dictionary of Nautical Terms, pp. 13–405, An Infobase Holdings Co., 1996.

Edited by B. W. Watson, United States Navy A Dictionary, pp. 61–63, Garland Publishing, Inc., 1991.

Captain, U.S. Navy, J. V. Noel, Jr., Captain, U.S. Navy, E. L. Beach, Naval Terms Dictionary, Fifth Edition, pp. 12–15/208–209, Naval Institute Press Annapolis, Maryland, 1988.

A.Ansted, Dictionary of Sea Terms, pp. 2–5, Glasgow Brown, Son & Ferguson, 1985.

C.W.T. Layton, Dictionary of Nautical Words and Terms, pp. 14–15, Brown, Son & Ferguson, 1982.

Captain USN, John V. Noel, The VNR Dictionary of Ships & the Sea, Van Nostrand Reinhold Co., 1981.

Joseph Palmer, Jane's Dictionary of Naval Terms, pp. 8–9, MacDonald and Jane's, 1975.

Graham Blackburn, The Illustrated Dictionary of Nautical Terms, pp. 10–13/92–101, David & Charles Newton Abbott, London, 1981.

Gershom Bradford, The Mariner's Dictionary, pp. 6–9/196–197, Barre Publishers Barre, Mass., 1972.

*Primary Examiner*—Stephen Avila
*Attorney, Agent, or Firm*—Workman, Nydegger & Seeley

[57] ABSTRACT

A modular anchor with a compressible spring member that permits its easy retrieval from the floor onto which the anchor became stuck. This retrieval is accomplished by merely pulling the anchor cable, the integrity of the cable being preserved as a consequence of the yielding of a spring member that is part of the modular anchor. The spring member compresses when it is subjected to sufficient pressure. The modular anchor may be disassembled to be carried in a bag with other elements useful for fastening a boat to shore. The anchor preferably has a fluke in the form of a plow or plowshare fluke.

41 Claims, 10 Drawing Sheets

SPRING BIASED MODULAR BOAT ANCHOR AND KIT

This application is a continuation-in-part patent application of U.S. patent application Ser. No. 09/198,739 filed by Richard Giles on Nov. 24, 1998, now U.S. Pat. No. 6,038,996 issued Mar. 21, 2000. U.S. patent application Ser. No. 09/198,739 is hereby incorporated in its entirety.

BACKGROUND OF THE INVENTION

1. The Field of the Invention

This invention relates to anchors that can be disassembled into modular components and stored and transported in a kit. More specifically, this invention relates to a modular anchor with an articulated arm that can pivot when sufficient pressure causes movement of a spring.

2. Relevant Technology

An anchor is any device used to secure a floating body to the bottom of a body of water. An anchor cable is any line, wire, chain, etc., that runs from the floating body to the anchor. It is called an anchor cable, regardless of its configuration. The term "boat" will hereinafter refer to any floating body that is made fast by means of an anchor.

The parts of an anchor comprise a shank, arms terminating in flukes, a crown, and a stock. Although these parts are designated by well-known terms in the art, these parts are briefly characterized below for introducing basic terminology.

The shank is an elongated body with two ends. One of the shank's ends has an orifice or similar feature for attachment of the anchor cable, either directly or by means for linking an anchor cable with the shank end, such as a ring or a ring and a shackle. An anchor buoy may also be connected by a taut line to an anchor at this orifice. At its other end, the shank forms the crown. In some anchors, two arms attach to the shank at the crown.

The arms extend away from the crown and terminate in flukes, which are pointed structures for digging into the floor at the bottom of a body of water. The floor at the bottom of a body of water is hereinafter referred to as "floor". When the flukes dig into the floor and the anchor holds the ground well, it is said to bite. When the anchor bites, the fluke or flukes and the shank define an angle that is typically less than 90°.

Some anchors do not have arms, and the flukes are attached directly or very close to the crown or to the corresponding end of the shank. Typically, anchors with arms have a generally longitudinal stock at the end of the shank opposite to the crown. The stock is usually perpendicular to the shank and it is contained in a plane that is perpendicular to the plane that contains the arms. In some anchors with no arms, the stock extends away form the crown, in about equal lengths to each side, and the flukes, usually twin flukes, are mounted one on each side of the crown. Other anchors have no stock. See A. Ansted, *A Dictionary of Sea Terms*, pages 3–4, (1985) (this book will hereinafter be referred to as "Dictionary of Sea Terms").

Anchors receive different names depending on their parts. For example, the Admiralty Pattern or Fisherman's Anchor has a stock at right angles to the arms which causes the anchor to lie so that one of the flukes will bite into the floor. It has been in use for about 2000 years, but it has been superseded for a number of applications by the Stockless Anchor. The arms of the Stockless Anchor hinge on the shank and usually have tripping palms which cause the flukes to bite into the ground when a pull is exerted on the anchor. The Danforth Anchor has a light stock at the crown extending beyond the flukes to ensure that both flukes lie flat and bite into the ground. The Plough, Ploughshare or CQR Anchor ("CQR" merely being a phonetic play on "secure") is nowadays usually carried by small boats. It is also used to anchor floating objects such as buoys and platforms. In this stockless anchor, the flukes, shaped like ploughshares, turn on the shank and dig into the ground when the boat pulls upon its anchor. Stockless anchors are generally referred to with the terms "patent anchors". The Mushroom Anchor is shaped as its name indicates and it is usually employed on mud or other soft floors. See *Dictionary of Sea Terms*, pages 4–5; C.W.T. Layton, *Dictionary of Nautical Words and Terms*, page 14 (1982); John V. Noel, Jr., and Edward L. Beach, *Naval Terms Dictionary*, page 208 (1988); Graham Blackburn, *The Illustrated Dictionary of Nautical Terms*, pages 92, 101 (1981); *Jane's Dictionary of Naval Terms*, compiled by Joseph Palmer, page 8 (1975), and for illustrations of different types of anchors, see Thompson Lenfestey, *Dictionary of Nautical Terms*, page 14 (1994). A solid anchor is one where the shank and flukes are forged together, while a portable anchor, hereinafter referred to as a "modular anchor" is capable of being taken to pieces. See Gershom Bradford, *The Mariner's Dictionary*, page 7 (1972) (this book will hereinafter be referred to as "Mariner's Dictionary"). Modem anchors of light weight and high tensile strength are popular for boats of small tonnage, especially yachts. See *Mariner's Dictionary*, page 8.

Pulling from an anchor's shank usually digs the fluke's tip into the floor, thus making the anchor bite. The anchor's bite prevents the boat from drifting away from a determined area in which the boat is to remain. When the boat is to be under way again, its anchor has to be retrieved from the floor. To weigh anchor is to get the anchor up in preparation for getting under way. This is done by first heaving short, which is performed by hauling upon the anchor cable until the boat is nearly over its anchor, a maneuver that should ordinarily bring the anchor apeak. This is the anchor's position when it stands on its crown. The anchor is subsequently lifted form the floor, at which point the anchor is aweigh, and ultimately awash or above the water surface. The boat has been under weigh from the moment its anchor is weighed. See *Dictionary of Sea Terms*, pages 3–4.

This entire maneuver of getting the boat under weigh can be accomplished provided that the anchor bites the floor without sticking the flukes under a heavy object that will prevent the fluke tips from generally pointing upwards. In other words, when the flukes get stuck or entangled, the anchor will not be apeak at the end of the process of heaving short and the anchor's retrieval will be difficult or impossible. Although reportedly infrequently, the impossibility of getting the anchor aweigh and its subsequent loss is reflected by the incorporation in insurance policies of an Anchor and Chain Clause. According to this marine insurance clause, the underwriter is typically free from expenses to recover lost anchors and chains lost while the boat is afloat. See Eric Sullivan, *The Marine Encyclopaedic Dictionary,* 5th ed., page 23, (1996), and John V. Noel, *The VNR Dictionary of Ships & The Sea*, page 9 (1981). These references referred to hereinabove are hereby incorporated by reference.

A number of patents have disclosed anchors of different types. Generally, most anchors' designs focus on the improvement of features that will enhance the anchor's holding ability. These features include flukes that can pivot over a limited angular range. Limited pivoting is usually accomplished by structural elements whose function is to prevent the flukes from widely pivoting. In other words, these structural elements actually confine the angle defined by the shank and the flukes to an angle that is significantly less than 90°. These include U.S. Pat. No. 5,154,133 to Hallerberg which discloses a twin-fluke anchor that can be assembled in two different configurations to vary the shank-fluke angle to optimize the anchor's holding power. The assembly allows for limited pivoting of the shank relative to the twin flukes. U.S. Pat. No. 4,058,078 to Stelling discloses a twin-fluke anchor in which the flukes are mounted on a cross-bar that is orthogonal to the anchor's shank. The shank is allowed limited pivoting about the cross-bar. U.S. Pat. No. 3,766,877 to Beck discloses a pivoted fluke anchor with shank, fluke, and stock that have surfaces that are substantially free of obstructions to the flow of bottom soil thereover. U.S. Pat. No. 3,759,212 to Cluett discloses an anchor comprising preferably a single, replaceable fluke, and a hinged shank. The hinged shank comprises two sections each secured to an opposite end of an elastically extensible shock cord. In this anchor, the shank is structured to reduce shock transmitted from a fixed anchorage to the anchor, rode, and deck mooring gear. Preferably, this anchor includes a single, replaceable fluke which is pinned at an angle to the shank during use, and which can be folded for storage. U.S. Pat. No. 3,306,248 to Austin discloses a twin-fluke anchor with a floating device to orient the tips of the flukes and a pin-based mechanism to adjust the maximum pivoting angle of the shank with respect to the anchor's stock. This angle can be adjusted for different earth conditions on the bottom of the river, lake or sea in which the boat is to be anchored.

Although considerable attention has been given to the improvement of the anchor's design for enhancing the anchor's bite to a variety of floor conditions, a considerable smaller number of references address the problem of retrieving an anchor that is stuck or wedged on the floor. This problem is addressed in U.S. Pat. No. 2,948,249 to Gesner et al. which discloses a collapsible single-fluke and shank anchor with a means for facilitating the anchor's release when it is engaged with the bottom of a body of water. To facilitate its release, the anchor's shank engages the fluke by means of a resilient holding clamp and a pivoting attachment with a cross-arm. This pivoting attachment permits the shank to pivot almost freely when it is dislodged from the holding clamp, thus facilitating the retrieval of the entire anchor.

The engagement of an anchor's shank with a resilient holding clamp in the fluke is a release mechanism whose actuation will be increasingly less predictable and reproducible as the number of actuations increases. By repeatedly removing the shank from the holding clamp and reinserting it into the holding clamp, the clamp's resilience will diminish and it will also wear out by friction. Consequently, the holding ability of the shank and holding clamp assembly will gradually become less predictable and reproducible. In addition, rust removal and general maintenance operations is most likely to lead to additional wear of the holding clamp and shank system. Whereas replacement of worn out or non-conforming parts is a solution that often restores standard working conditions to an otherwise poorly performing mechanism, replacement is difficult when the holding clamp is built into the fluke, for its replacement would imply the disposal of the anchor or at least of its fluke, or the involvement of significant specialized work for removing and reattaching the worn out parts.

Conventional anchors do not have simple, reproducible and predictable features that would allow for the easy retrieval of the anchor when it is stuck in the floor. Recovery of these anchors becomes difficult or impossible. It is therefore desirable to provide an anchor with built in features that are simple, whose behavior is reproducible and predictable, and that facilitate the easy retrieval of the anchor when it would otherwise have to be abandoned on the floor after considerable time spent in attempting to free and recover it.

Each one of the afore-mentioned patents is hereby incorporated by reference in its entirety for the material disclosed therein.

SUMMARY AND OBJECTS OF THE INVENTION

An anchor that has become irretrievable usually wastes significant time while attempting to recover it. In addition, a lost anchor is a material loss, and it may prevent a boat from further sailing if no anchor replacement is available when in fact an anchor is needed.

Attempts to retrieve an anchor can be very time consuming, particularly when the boat is not equipped with retrieval means that are sufficiently powerful. Sometimes a dive is required to release an anchor that is stuck under objects that would render it irretrievable. When the mechanical retrieval means are powerful enough, attempting to retrieve an anchor that is stuck on the floor may lead to the rupture of the anchor cable and the loss of the anchor. Carrying spare anchors on board is not a convenient practice, but sailing with no anchor may simply be unacceptable and it could lead to an unexpected termination of a sailing trip or to a considerable loss of time while attempting to acquire a replacement anchor.

It is therefore desirable to provide an anchor that can easily be retrieved without significant material loss when it gets stuck in the floor. This anchor should be made of materials of which conventional anchors are ordinarily made, and it should incorporate components that are easy to install, replace and manufacture. This anchor should meet in particular the needs of small to medium sized boats with their inherent limitations in storage space.

The general object of this invention is to provide an anchor that can easily be retrieved from the floor when it is stuck thereon. More specifically, it is an object of this invention to provide an anchor that can be retrieved from the floor by simply pulling on the anchor cable without loosing the anchor and without causing the anchor cable to break upon the applied strain.

It is another object of this invention to provide an anchor that is modular, that can be easily assembled, and whose disassembled parts can be compactly stored.

It is another object of this invention to provide a modular anchor that can be part of a kit comprising the anchor assembly elements and other means for preventing the drifting of the boat.

It is another object of this invention to provide a modular anchor that can easily be retrieved from the floor when it is stuck therein and whose features can be incorporated into a plurality of existing types of anchor. In particular, it is an object of this invention to provide a modular plow anchor that can be easily retrieved from the floor when it is stuck thereon.

These and other objects of this invention are achieved by a modular anchor and a kit, the modular anchor comprising a shank, one of whose ends is pivotally engaged to a mount on a fluke. This mount is attached to the fluke or more specifically to the anchor's crown. Pivoting of the shank with respect to the fluke is allowed by the compression of a spring member, such as a spiral spring, upon subjecting it to a predetermined pressure. When the shank and the mount pivot with respect to each other, the angle defined by the fluke and the shank can approach 180° if necessary, however, the range of motion will more typically be no greater than about 90°. This pivoting permits the extraction of the anchor from under objects or other elements with which the anchor became stuck.

The substitution or replacement of the element in this invention that compresses prior to the pivoting of the shank with respect to the fluke is easy and it can be performed at will. Consequently, the predictability and reproducibility of the mechanical properties of this device can be maintained as part of the anchor's performance standards. These properties characterize the conditions under which the shank will be allowed to widely pivot with respect to the fluke.

The widening of the space between the shank and the fluke by pivoting advantageously renders the anchor in the present invention in a configuration that permits its extraction when the anchor's fluke is stuck under some heavy object on the floor.

The compressible element in this invention is chosen according to the predetermined stress level that will cause its compression or bending. The replaceable character of this element and its predetermined characteristic yield point are other advantages of this invention.

A further advantage of this invention is that the conditions that determine the wide pivoting of the shank with respect to the fluke are not susceptible to significant variation as a consequence of rust formation, wear caused by multiple actuation, or maintenance service. This is because the compressible element can be removed, reinserted, and replaced at will. In particular, this element can be removed for cleaning and maintenance purposes and it can be periodically replaced after a predetermined characteristic time period of use. The advantageous disposable character of this compressible element supplements and enhances other advantages of this invention. Furthermore, it is easy to carry a spare set of such compressible elements of different compression point characteristics.

The modular character of this invention is another advantage that renders it especially suited for boats with limited storage space. This advantage is further enhanced by the portability of an anchor that embodies this invention, which can be transported from one boat to another boat. The modular character also allows for the replacement of individual parts without having to purchase another full anchor.

Another advantage of the present invention is that its constituent parts can be manufactured with the same materials that are used in the construction of conventional anchors. Consequently, any embodiment of the present invention can be made with materials of desired strength, durability, and density without having to resort to specialized technologies.

Additional objects and advantages of the invention will be set forth in the description which follows, and in part will be obvious from the description, or maybe learned by the practice of the invention. The objects and advantages of the invention maybe realized and obtained by means of the instruments and combinations particularly pointed out in the appended claims.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to modular boat anchors. More particularly, the present invention relates to a modular boat anchor with an articulated shank that can be pivoted by pulling from the shank while applying a strain that is greater than the limit condition determined by a predetermined stress range. When this limit condition is satisfied, the compression point of one of the anchor's elements is reached and the shank can widely pivot with respect to the fluke. In addition, the present invention also relates to a kit for carrying the disassembled modular anchor. The exemplary embodiments shown in FIGS. 1–6 illustrate features of the present invention that will be discussed hereinbelow.

Figure 6:
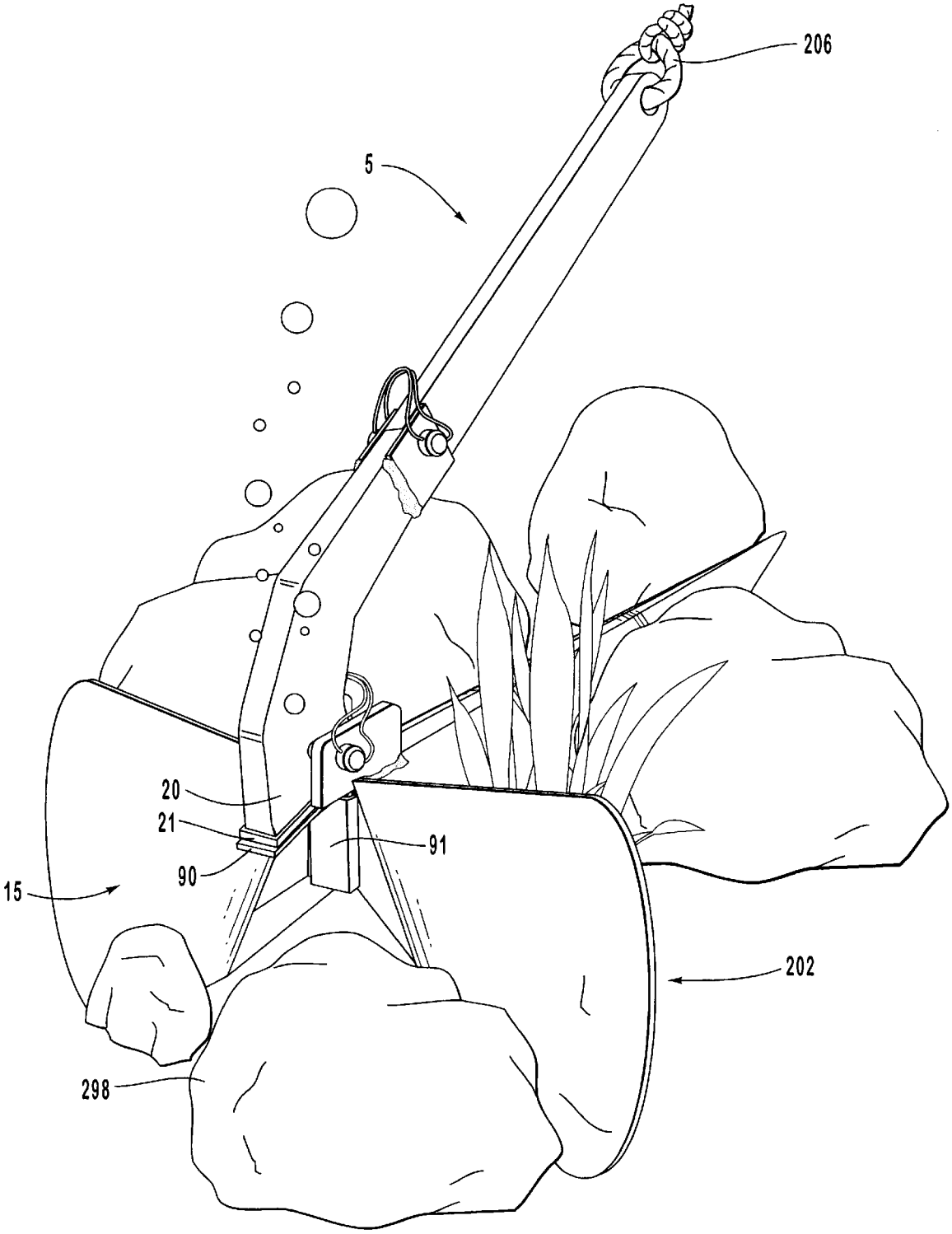
FIG. 6 is a schematic representation of the extraction of a modular anchor stuck at the bottom of a body of water.

The primary components include a shank 10, a fluke 15, a pivot pin 86 and a spring member such as compressible elbow 90. Fluke 15 is detachably coupled to one end of the shank by a pivot pin 86 which allows the shank to widely pivot with respect to the fluke when sufficient pressure is the compressible elbow 90. This pivoting takes place when a pull applied to the anchor's shank results in a certain compression of compressible elbow 90 which causes elbow 90 to bend as shown in FIG. 6.

Figure 1:
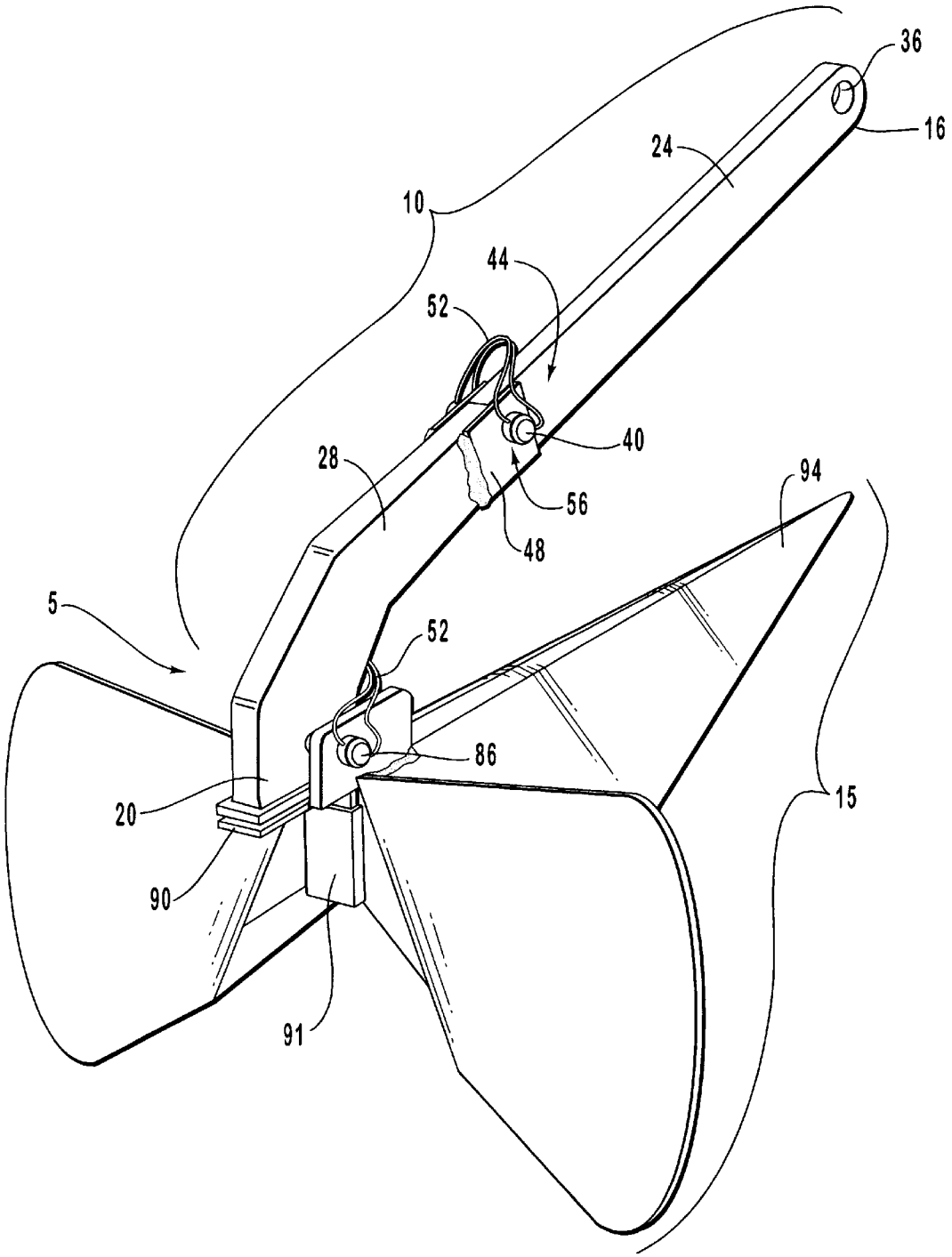
FIG. 1 is a perspective of a modular anchor with a ploughshare fluke in accordance with the present invention.

As shown in FIG. 1, an exemplary embodiment of the present invention comprises shank 10 detachably coupled to fluke 15. Fluke 15 as shown in the accompanying figures is a preferred embodiment of a fluke, however, the fluke may be any other fluke known in the art and that is described in material that has been incorporated hereinabove by reference. These flukes include twin flukes, the Danforth anchor's flukes, and the flukes of a stockless anchor in which the arms hinge on the shank and usually have tripping palms that cause the flukes to bite into the ground when a pull is exerted on the anchor. Fluke 15 and the other flukes disclosed herein are examples of fluke means for embedding in a water floor to prevent a water craft from drifting away from a determined area.

Figure 8:
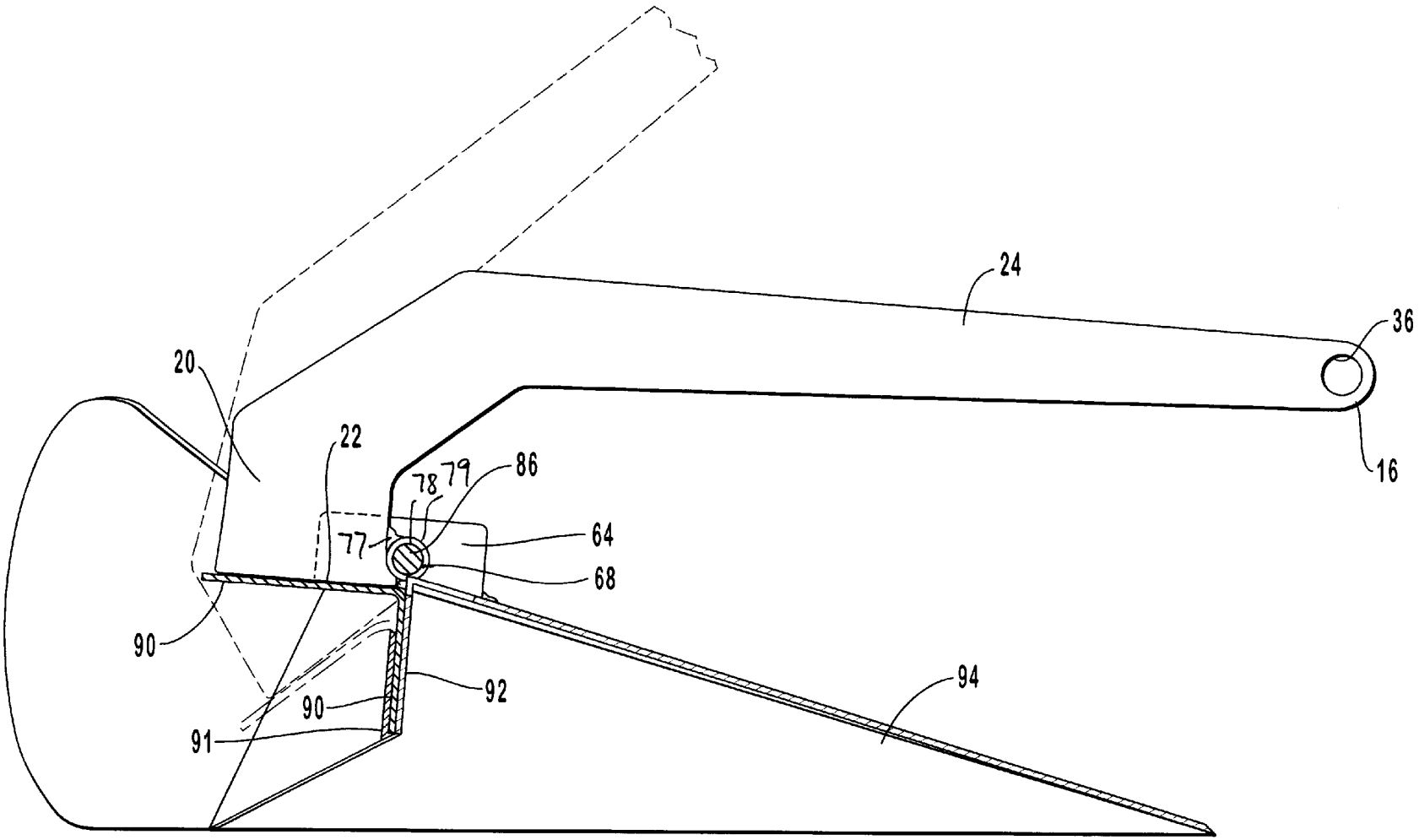
FIG. 8 is a cross sectional view of another embodiment of the invention.

Although in most anchors, shank 10 is a single integral piece extending from link end 16 to pivot end 20, a preferred shank for an embodiment of the present invention comprises a plurality of components, in particular, attachment stem 24 and coupling arm 28 that are detachably connected to each other by pin 40 at coupling end 44 of attachment stem 24 and end 48 of coupling arm 28. The shank can also be a single integral piece with no welded components as shown in FIG. 8. The shanks disclosed herein are examples of shank means for connecting an anchor cable to a fluke means.

Link end 16 has an orifice, such as orifice 36 for attaching an anchor cable therethrough, either directly or by means for linking an anchor cable with link end 16 such as a ring or a ring and shackle combination. Link end 16 may have any suitable aperture and be used in conjunction with attachments or linking means known to anyone of ordinary skill in the art for linking an anchor cable to link end 16.

Pin 40 is preferably accompanied by a restraining device that is embodied in FIG. 1 by clip-type device 52. When used for restraining a pin, clip-type device 52 is preferably used with a pin that has a corresponding groove at one of the pin's ends and a perforation at the opposite end, as shown in FIG. 1, although it can also be used with a pin that has a corresponding groove at each one of its ends. Pin 40 is a preferred embodiment of a detachable coupling means for coupling attachment stem 24 with coupling arm 28. Detachable coupling means can be embodied by any device that can be inserted through matching apertures 56 at end 44 of attachment stem 24 and at end 48 of coupling arm 28, provided that its strength is such that it can withstand the strain derived from the pulling of shank 10 from link end 16 when the anchor bites or when an attempt to retrieve the anchor is made. This mechanical characteristic is known by a person of ordinary skill in the art for the materials that can be used for manufacturing pin 40 or an equivalent detachable coupling means. Although, pin 40 is preferably embodied by generally cylindrical pins, it is understood that this pin can also be embodied by a pin whose cross section is not generally circular provided that the apertures that receive the pin are correspondingly shaped. Other objects that can specifically embody this detachable coupling means include a shackle, a ring, a bolt, and a nut and bolt pair. Clip-type device 52 is an example of a restraining means for holding the pin within the apertures.

As shown in FIG. 1, end 48 is configured to receive end 44. In an equally preferred embodiment, end 44 can be configured to receive end 48. Furthermore, the receiving end can be integrally formed into or attached by welding to the shank. The perimeters of ends 44 and 48 are shown in FIG. 1 and accompanying figures as being generally rectangular. It is understood that other perimeters for either of these two ends could have any plurality of shapes, such as round, polygonal, or comprising a combination of arcuate and rectilinear portions.

Figure 3:
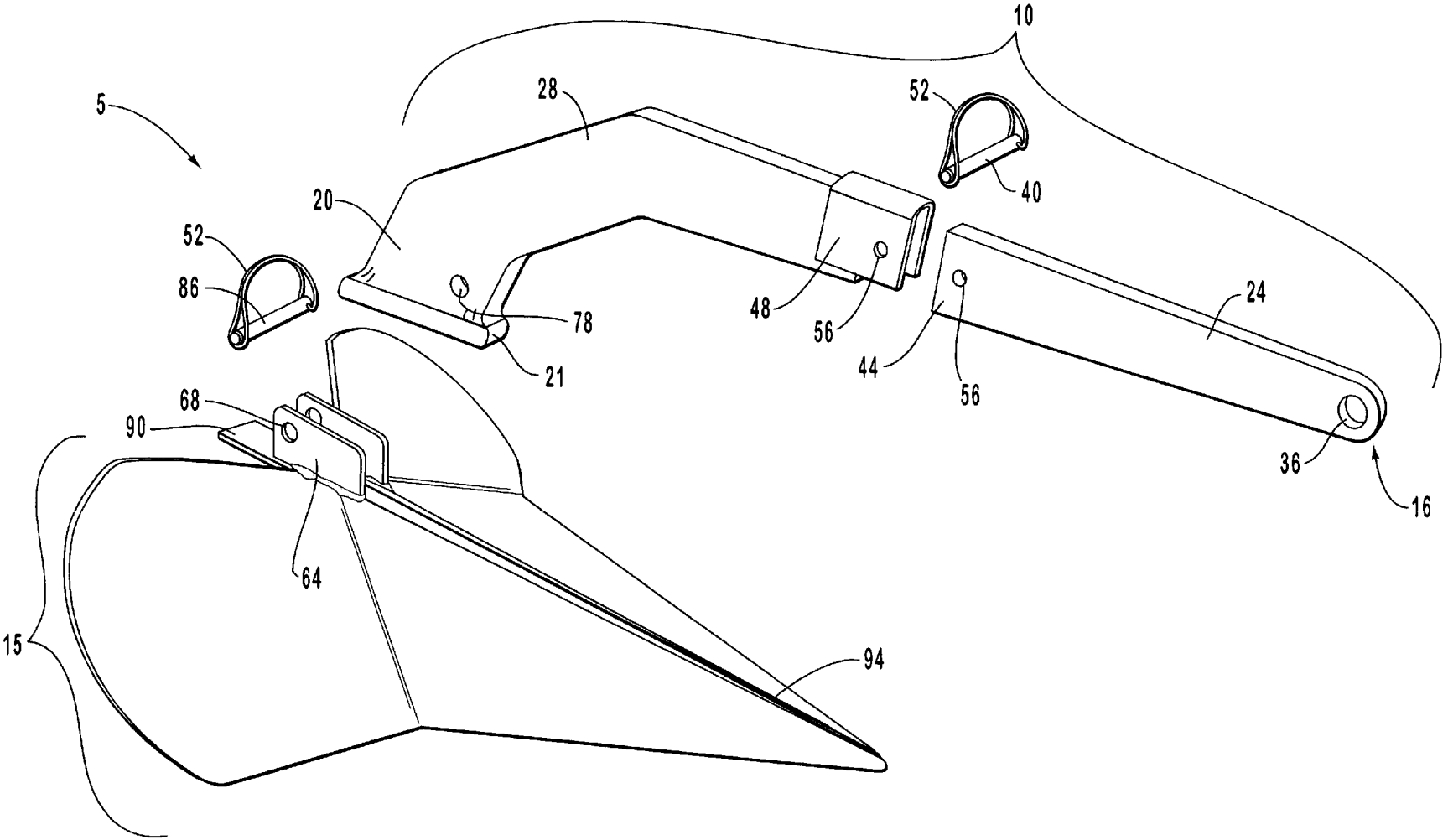
FIG. 3 is an exploded view of the embodiment shown in FIG. 1.

The elements described above are further illustrated in the exploded view shown in FIG. 3. Mount 64 in fluke 15 has a hinge aperture 68. Pivot end 20 of coupling arm 28 has a pivot aperture 78. As shown in FIG. 3, pivot end 20 is configured for detachably coupling with mount 64. In the specific embodiment shown in FIG. 3, pivot end 20 is received by mount 64. Furthermore, the perimeter of mount 64 and pivot end 20 are shown in FIG. 3 as being generally rectangular. It is understood that other perimeters for anyone of these two elements could have a plurality of shapes, such as round, polygonal, or comprising a combination of arcuate and rectilinear portions.

Pivot end 20 can an integral portion of shank 10 with integral flanges 21. Similarly, the pivot end and the flanges can also be welded components of shank 10. Analogously, mount 64 can be integrally formed into the fluke or it can be attached to the fluke by welding as shown. In the embodiments disclosed herein, the mount is part of the fluke. Accordingly, the fluke means includes a mount.

Figure 2:
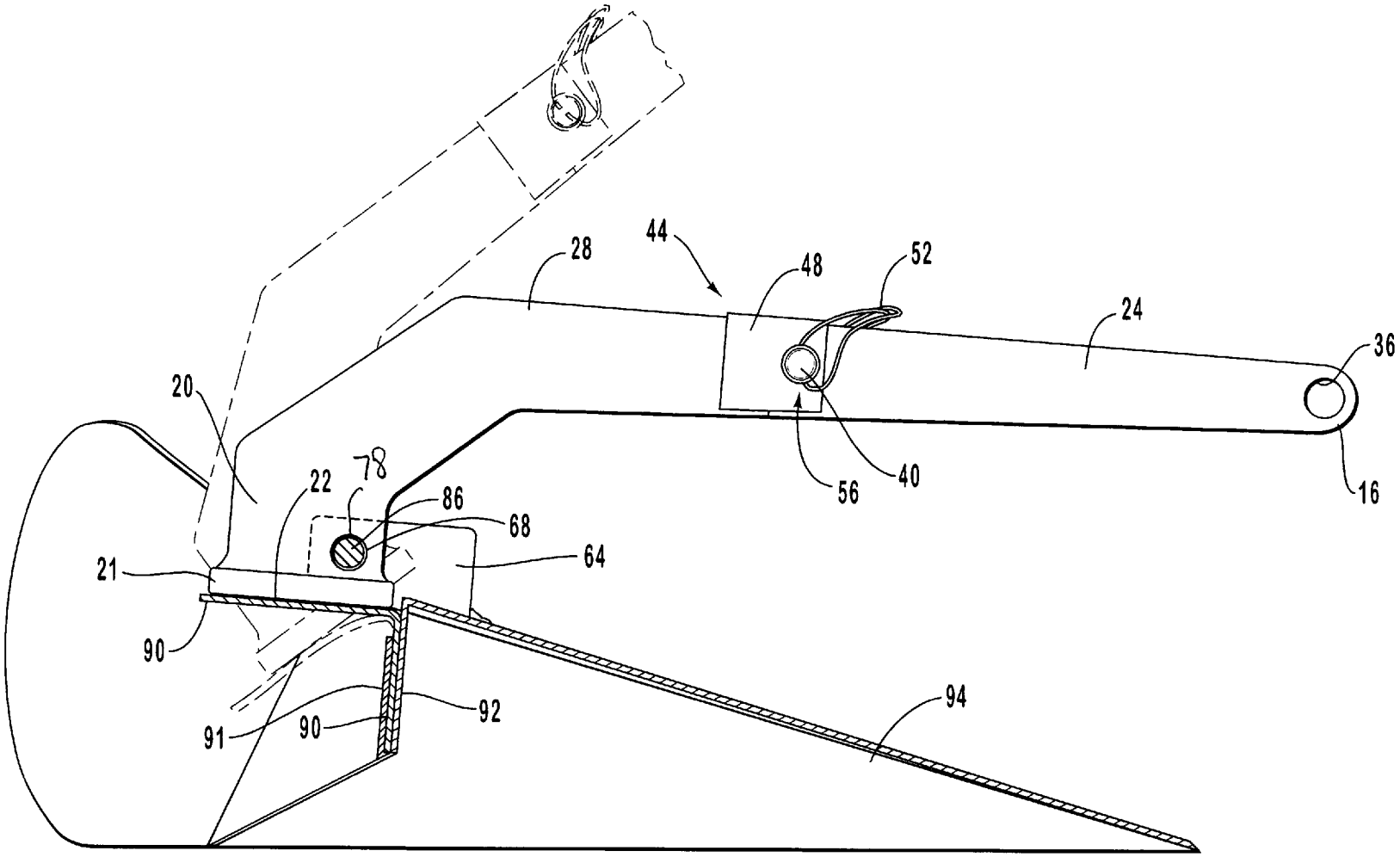
FIG. 2 is a cross sectional view of the embodiment shown in FIG. 1.

In a preferred embodiment of this invention, shank 10 is detachably coupled to fluke 15 with pivot pin 86. Pivot pin 86 is an embodiment of a pivot means for pivotally fastening shank 10 with fluke 15. Pivot pin 86 as shown in FIGS. 1 and 2 is a preferred embodiment of a pivot means. In addition to pivot pin 86, the pivot means can be embodied by a hinged device or by any device that can be inserted through hinge aperture 68 and pivot aperture 78 provided that its strength is such that it can withstand the strain derived from the pulling of shank 1 from link end 16 when the anchor bites or when an attempt to retrieve the anchor is made. This mechanical characteristic is known by a person of ordinary skill in the art for the materials that can be used for manufacturing this pivot means. More particularly, in addition to pivot pin 86, other objects that can specifically embody this pivot means include a shackle, a ring, a bolt, and a nut and bolt pair.

Compressible elbow 90 is an embodiment of a spring means for enabling shank 10 and fluke 15 to pivot with respect to each other at pivot pin 86 when sufficient pressure is applied to compress compressible elbow 90. Embodiments of this spring means have a characteristic compression point at which point the spring means compresses to allow the pivoting action. As shown in FIG. 6, compression of compressible elbow 90 enables shank 10 and fluke 15 to pivot such that fluke 15 can become dislodged after becoming stuck in undesired manner.

Any embodiment of the spring means is chosen so that it has a certain compression point which can be reached to compress the spring means when the link end is pulled with the anchor immobilized in an undesired manner at any region of the fluke. This compression point has to be high enough so that it is not reached as a consequence of the normal strain applied to the spring means when the anchor bites while ordinarily holding a boat. However, this compression point should not be so high that the anchor cable will break prior to the compression of the spring means while attempting to retrieve an anchor that is stuck on the floor. According to this criterion, and with supplementary information such as known strengths of materials, and known stresses induced by pulls exerted by different forces, selecting the manufacturing materials for making the spring means of different characteristic compression points should be a well-known process to a person of ordinary skill in the art.

One of ordinary skill in the art will readily appreciate that while compressible elbow 90 is shown in FIG. 2 with one end attached to receiving surface 92 of fluke 15 and with the other end extending unattached to shank 10 in a position such that the unattached end can be pushed by pushing surface 22 of shank 10 other configurations are equally suitable. For example, the configuration can be reversed such that the end of compressible elbow opposite pushing surface 22 is attached to shank 10 while the other end extends unattached and opposite receiving surface 92. Additionally, both ends of compressible elbow 90 can be attached to the respective opposing surfaces of fluke 15 and shank 10.

Figure 4A:
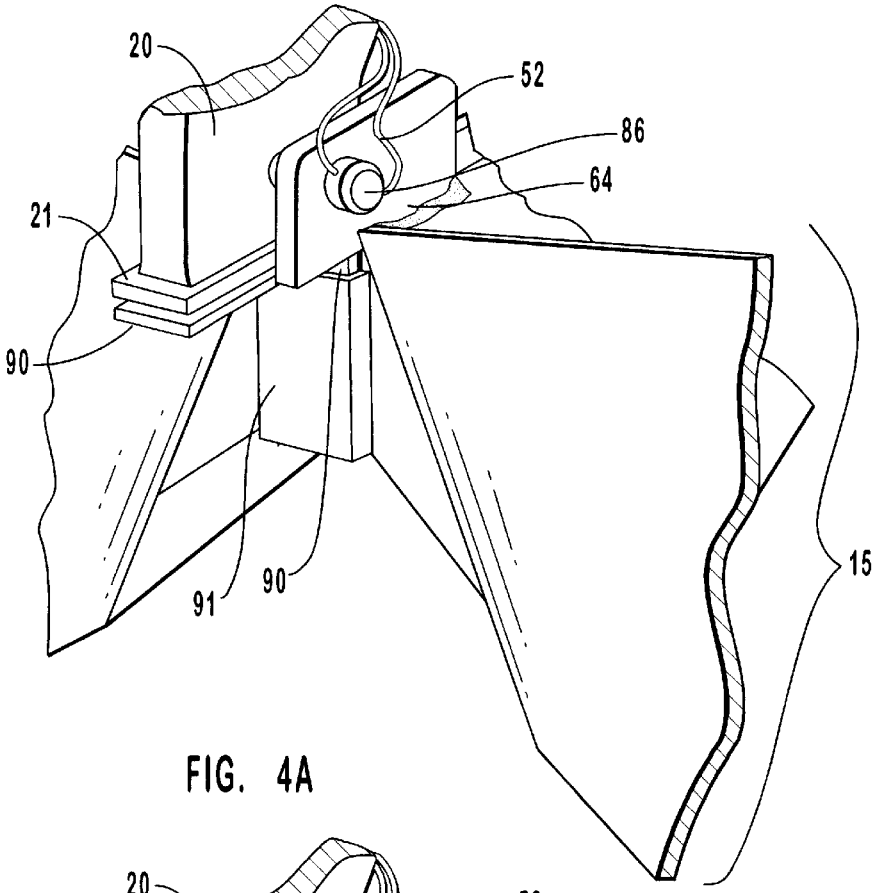
FIG. 4A is an enlarged perspective view of the compressible elbow shown in FIG. 1.
Figure 4B:
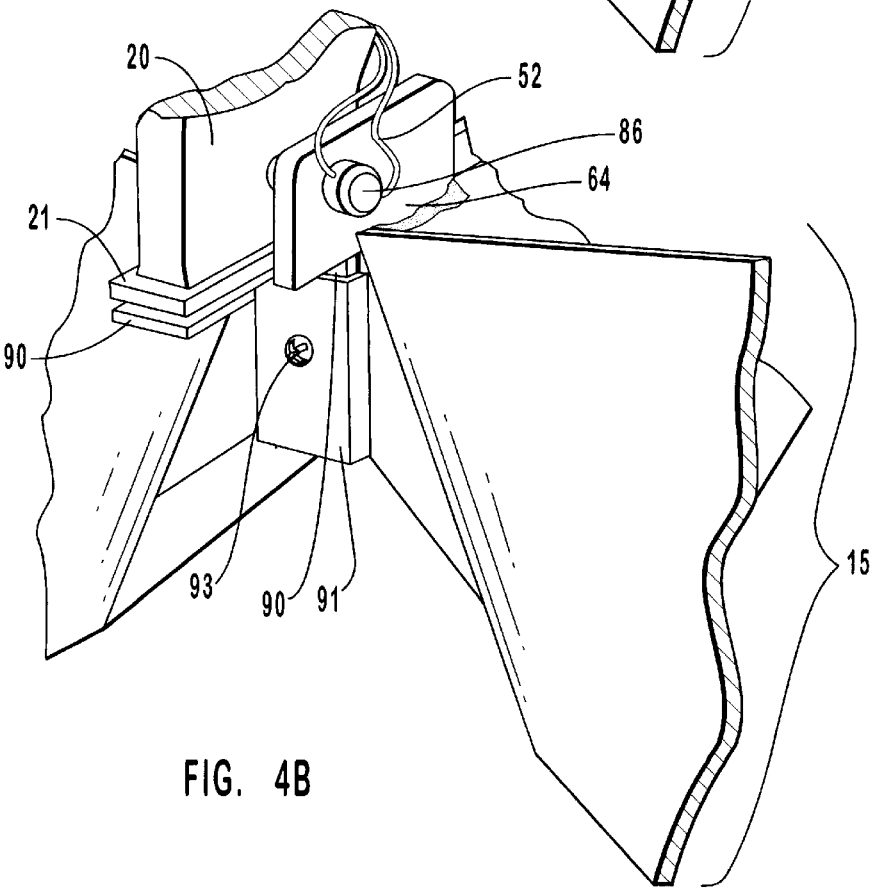
FIG. 4B is an enlarged perspective view of another embodiment of compressible elbow.
Figure 4C:
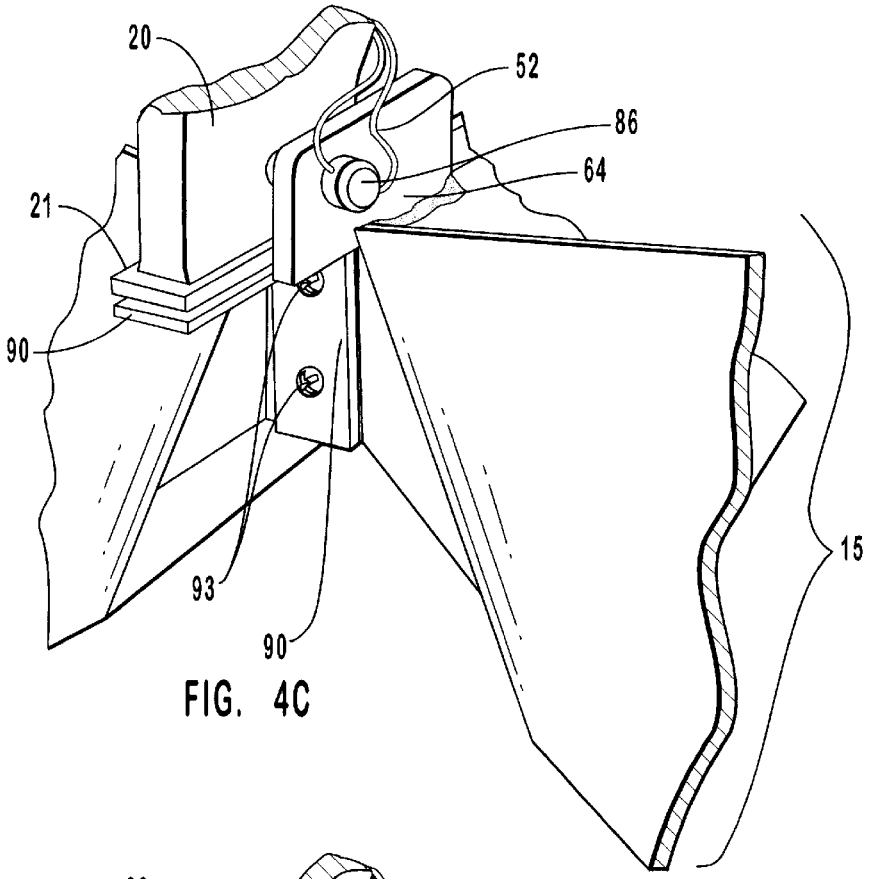
FIG. 4C is an enlarged perspective view of another embodiment of compressible elbow.
Figure 4D:
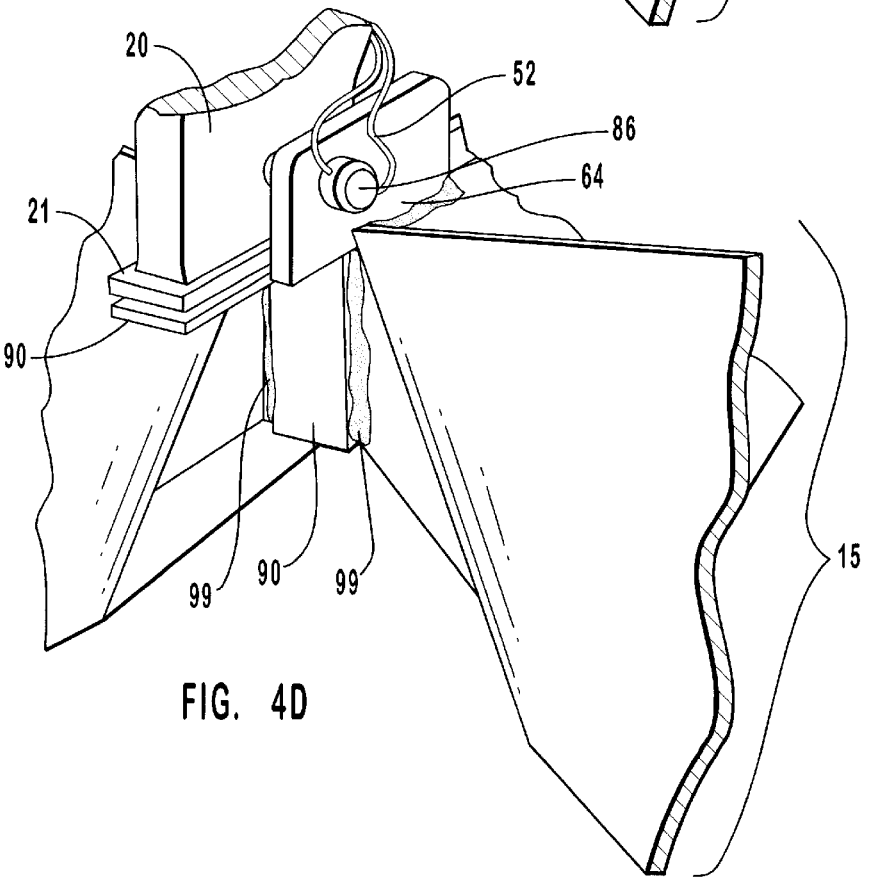
FIG. 4D is an enlarged perspective view of another embodiment of compressible elbow.

Compressible elbow 90 is shown in FIGS. 4A–4D having one end positioned to engage the shank and the other end positioned to engage the fluke. FIGS. 4A–4C depict exemplary embodiments of detachable compressible elbows. The compressible elbow depicted in 4D is not detachable as it is welded to fluke 15. In FIG. 4A, compressible elbow 90 is positioned within a pocket 91 which is connected to shank 10. Pocket 91 can be mounted on receiving surface 92 of shank 10 or pocket 91 can be integral portion of shank 10. FIG. 4B is similar to FIG. 4A, however, a screw is positioned through pocket 91 and compressible elbow 90 to prevent undesired movement of compressible elbow 90. The embodiment depicted in FIG. 4C also provides for detaching compressible elbow 90 while also ensuring that compressible elbow 90 cannot move when held in position by screws 93. The compressible elbow shown in FIG. 4C has no pocket and is mounted directly onto receiving surface 92.

The embodiments of the compressible elbows depicted in FIGS. 4A–4C are all detachable. Accordingly, these detachable compressible elbows are examples of detachable spring means for enabling shank 10 and fluke 15 to pivot with respect to each other at pivot pin 86 when sufficient pressure is applied to compress compressible elbow 90 which can be detached and replaced as needed. The compressible elbow depicted in 4D, however, is not detachable as it is welded to fluke 15. It is preferable to have the compressible elbow replaceable as the compressible elbow or other spring member may not be sufficiently resilient to be used after compression of the spring member has occurred. If the detachable spring member is not resilient, then the spring member can be easily removed and replaced.

Although, the embodiments shown herein depict a range of movement of about 90° as compressible elbow 90 is compressed, the configuration can be modified to significantly increase the range of motion. Accordingly, the angle defined by the fluke and the shank may be 120°, 150° and may even approach up to 180° if necessary.

FIG. 6 shows how an embodiment of the present invention is retrieved after getting stuck in heavy objects 298 on floor 202. The pull applied through anchor cable 206 causes compressible elbow 90 to reach its characteristic compression point, thus enabling shank 10 and fluke 15 to pivot. The pivoting of shank 10 with respect to fluke 15 about pivot pin 86 allows for the effective disengagement of fluke 15 from heavy objects 298 that would have otherwise prevented the easy retrieval of the anchor by merely pulling anchor cable 206.

Figure 5:
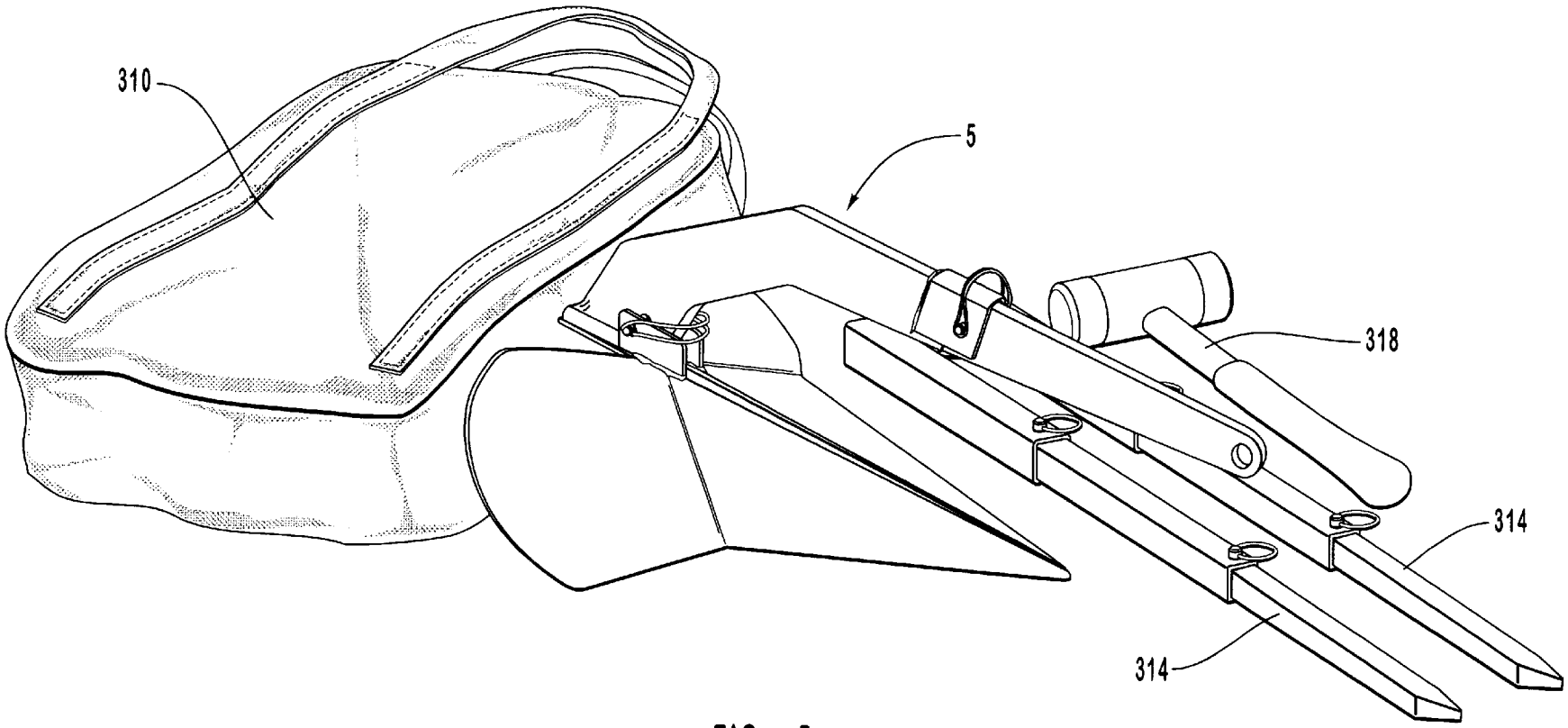
FIG. 5 is a perspective view of a modular anchor and other elements in the kit in accordance with the present invention.

FIG. 5 shows a kit according to the present invention. In addition to a modular anchor 5 according to the present invention, this kit comprises bag 310, stakes 314 and hammer 318. Telescopic stake 314 is a preferred embodiment of stake means for fastening a line from a boat to a watershore. Bag 310 shown in FIG. 6 is a preferred embodiment of a carrying means for receiving the anchor's modular components after disassembly. This carrying means can also be embodied by a carrier that internally or externally receives the modular components of an anchor and any additional embodiments of stake means and hammer 318.

Figure 7:
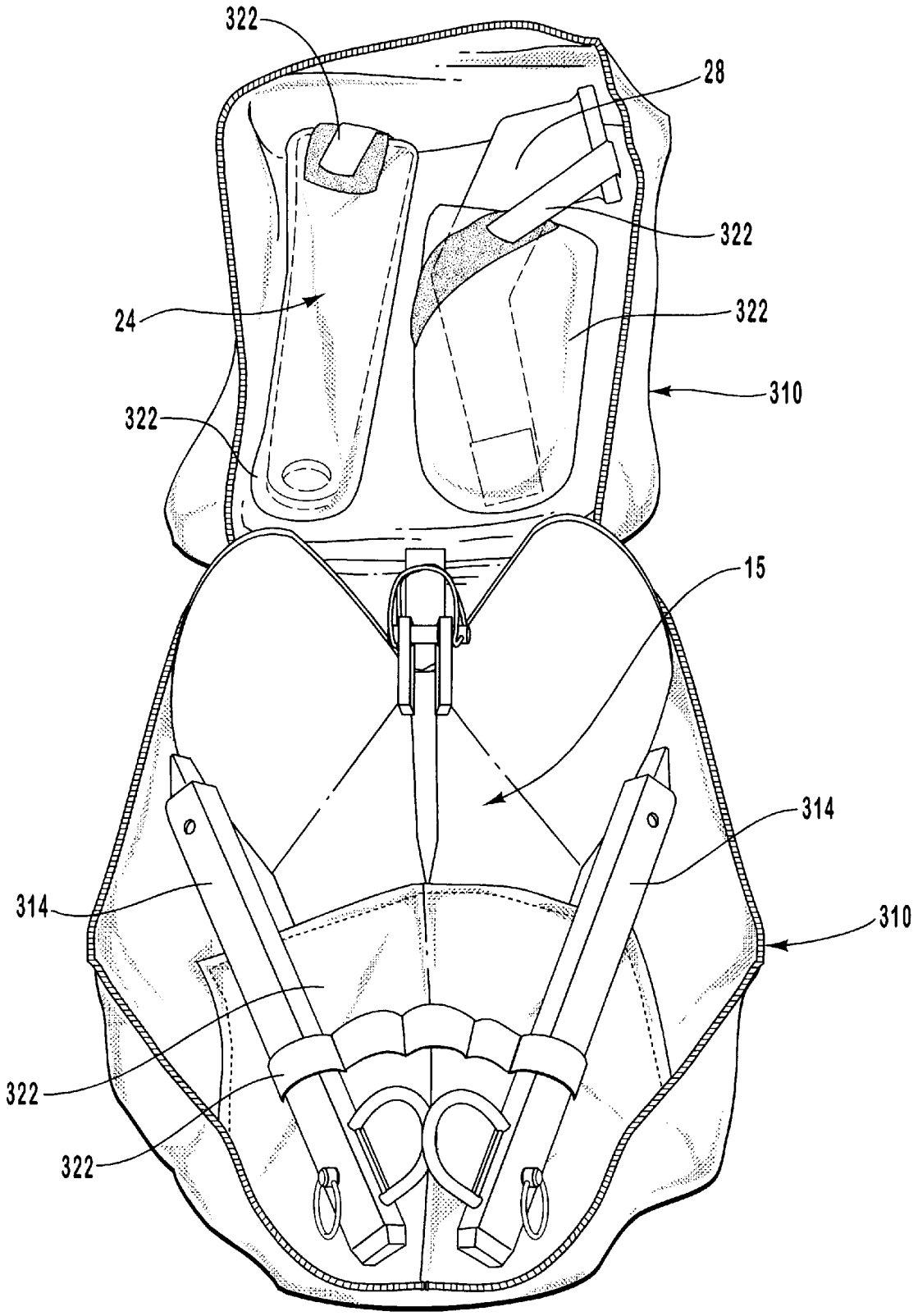
FIG. 7 is a perspective view of a disassembled modular anchor and other elements stowed in a carrying bag in accordance with the present invention.

FIG. 7 shows an embodiment of a kit according to the present invention with bag 310 internally receiving the modular components of a modular anchor and any additional embodiments such as those of the stake means. Preferably, bag 310 or any of its equivalent embodiments contains retaining means for keeping the anchor's modular components and any additional embodiments such as those of stake means. These retaining means can be embodied by retainers 322 shown in FIG. 7, and more specifically by pouches, straps, loops, pockets and combinations thereof.

FIG. 8 is a cross-sectional view which shows shank 10 having a pivot aperture 78 positioned to enable a greater range of motion than in the embodiment depicted in the cross-section view shown in FIG. 2. Pivot aperture 78 is located in a more offset position in FIG. 8 than in FIG. 2. More particularly, pivot aperture in FIG. 8 is lower than in FIG. 2 and is positioned further to the outside of pivot end 20 of coupling arm 28. The pivot aperture shown in FIG. 8 is defined by a loop or hinge member 79 welded at 77 onto the exterior of pivot end 20. Accordingly, pivot aperture may be located within pivot end or may be externally mounted on pivot end 20. As previously indicated, FIG. 8 also depicts shank 10 as being an integral member.

Pivot end 20 is preferably configured to prevent forward pivoting of link end 16 toward nose 94. With the exception of the embodiment depicted in FIG. 8, forward pivoting is prevented by contact between pushing surface 22 and the top of fluke 15. Additionally, forward pivoting may also be prevented by flange 21 contacting a protrusion (not shown) extending from mount 64 above flange 21 and toward pivot end 20 which is configured to engage flange 21. Since, with the exception of the embodiment shown in FIG. 8, the location of aperture 78 ensures contact between pushing surface 22 and the top of fluke to prevent forward pivoting, the flange and such protrusions are not necessary. Although, pivot end 20 shown in FIG. 8 does not have flanges, flanges are actually preferred with this embodiment to prevent forward movement. Accordingly, pivot end preferably has means for preventing forward pivoting of shank 10 toward fluke 15 such that link end 16 of shank 10 does not approach nose 94 of fluke 15.

Figure 9:
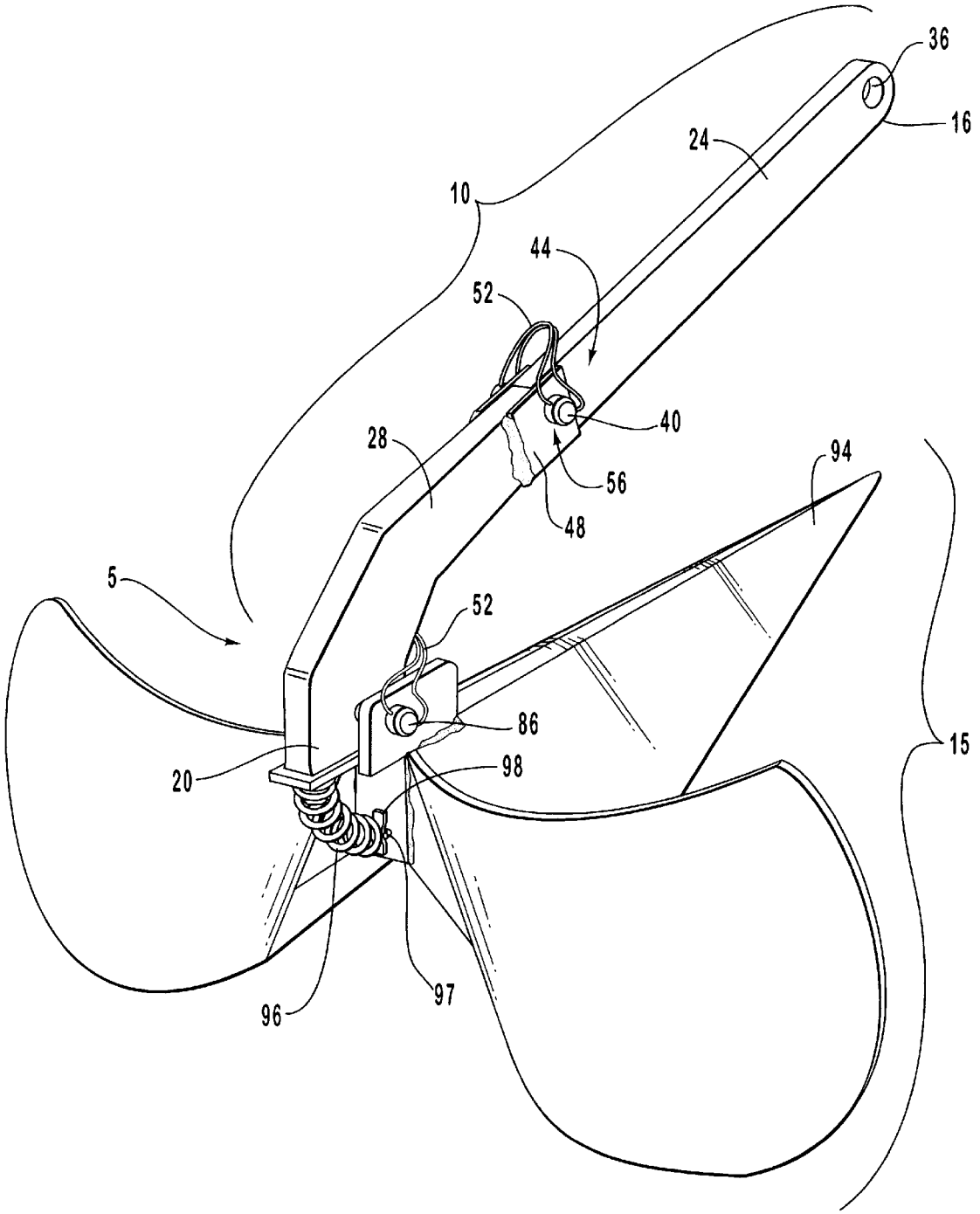
FIG. 9 is a perspective view of another embodiment of the invention.

FIG. 9 depicts another embodiment wherein the spring member is a spiral spring 96. Spiral spring 96 has opposing hook ends 97. One hook end is detachably connected to fluke 15 via a loop 98 extending from fluke 15 while the other hook end is also detachably connected to shank 10 via a loop (not shown) extending from pushing surface 22 of shank 10. Spiral spring 96 is preferably resilient such that it can be used repeatedly after compression.

FIG. 9 also depicts a plowshare fluke 15 configured to digs into the floor of a body of water in a similar fashion to a snow plough so that the displaced material is deposited onto nose 94. By directing the displaced material onto nose 94, fluke 15 becomes more securely anchored. Since the pivotability of anchor 5 enables it to be removed when stuck or deeply embedded, the design of the anchor combines the benefits of more secure anchoring with greater releasability. As previously indicated, the fluke means can have any shape. While fluke 15 is shown as an integrally formed component, the fluke can also comprises two symmetrical halves such as the two fluke unit depicted in FIG. 4 of U.S. patent application Ser. No. 09/198,739. If the fluke comprises two halves, pin 86 may extend through the two halves and is preferably used to hold the two halves together.

As indicated hereinabove, pin 40 and 86 are preferably accompanied by a restraining means for holding the pin within the apertures. While these pins are shown with two perforated ends for a restraining device, these pins may also have one flanged end and one perforated end. Additionally, any suitable restraining means may be utilized. In addition to the examples of restraining means set forth herein, other examples of suitable restraining means are also provided in U.S. patent application Ser. No. 09/198,739. For example, the pin may have a flanged head opposite a cotter pin or a rue ring cotter pin. Similarly, a bolt may be inserted through the aperture and secured with a bolt. Other examples of suitable restraining means includes any element that can be securely inserted through the aperture, such as a ring or a clamp, as well as a shackle and a pin.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A modular boat anchor, comprising:

a shank with a link end and a pivot end, said pivot end having a pivot aperture;

fluke means for preventing a water craft from drifting away from a determined area, said fluke means being configured for detachably coupling with said pivot end of said shank, said fluke means having a hinge aperture;

pivot means for pivotally fastening said shank with said fluke means at said pivot aperture of said shank and at said hinge aperture of said fluke means; and a compressible elbow having one end positioned to engage said shank and the other end positioned to engage said fluke means to enable said shank and said fluke means to pivot with respect to each other at said pivot means when sufficient pressure is applied to compress said compressible elbow.

2. A modular boat anchor as recited in claim 1, wherein said shank comprises an attachment stem and a coupling arm, said attachment stem having a stem coupling end with at least one stem aperture, said coupling arm having an arm coupling end with at least one arm aperture, said attachment stem being connected to said coupling arm by means for coupling said attachment stem with said coupling arm at said stem aperture of said attachment stem and at said arm aperture of said coupling arm.

3. A modular boat anchor as recited in claim 2, wherein said coupling means is selected from the group consisting of a pin, a shackle, a ring, a bolt, and a nut and bolt pair.

4. A modular boat anchor as recited in claim 1, wherein said fluke means has a mount configured to receive said pivot end of said shank and wherein said hinge aperture is located in said mount.

5. A modular boat anchor as recited in claim 1, wherein said fluke means comprise a plough-shape fluke.

6. A modular boat anchor as recited in claim 1, wherein said pivot means is selected from the group consisting of a pin, a bolt, a bolt and a nut, a ring, and a shackle.

7. A modular boat anchor as recited in claim 1, wherein said compressible elbow is not resilient.

8. A modular boat anchor as recited in claim 1, wherein said compressible elbow is resilient.

9. A modular boat anchor as recited in claim 1, wherein said compressible elbow is detachably attached to the fluke means.

10. A modular boat anchor as recited in claim 1, wherein said compressible elbow is detachably attached to the shank.

11. A modular boat anchor, comprising:

a shank with a link end and a pivot end, said pivot end having a pivot aperture;

a fluke configured to be embedded in a water floor to prevent a water craft from drifting away from a determined area, said fluke being configured to be detachably coupled with said pivot end of said shank, said fluke having a hinge aperture;

a pivot fastener positioned in said pivot aperture of said shank and in said hinge aperture of said mount for pivotally fastening said shank together with said fluke; and a compressible elbow having one end positioned to engage the shank and the other end positioned to engage the fluke to enable said shank and said fluke to pivot with respect to each other at said pivot fastener when sufficient pressure is applied to compress said compressible elbow.

12. A modular boat anchor as recited in claim 11, wherein said shank comprises an attachment stem and a coupling arm, said attachment stem having a stem coupling end with at least one stem aperture, said coupling arm having an arm coupling end with at least one arm aperture, said attachment stem being connected to said coupling arm by means for coupling said attachment stem with said coupling arm at said stem aperture of said attachment stem and at said arm aperture of said coupling arm.

13. A modular boat anchor as recited in claim 12, wherein said coupling means is selected from the group consisting of a pin, a shackle, a ring, a bolt, and a nut and bolt pair.

14. A modular boat anchor as recited in claim 11, wherein said fluke has a mount configured to receive said pivot end of said shank and wherein said hinge aperture is located in said mount.

15. A modular boat anchor as recited in claim 11, wherein said pivot fastener is selected from the group consisting of a pin, a bolt, a bolt and a nut, a ring, and a shackle.

16. A modular anchor as recited in claim 11, wherein said compressible elbow is resilient.

17. A modular boat anchor as recited in claim 11, wherein said compressible elbow is resilient.

18. A modular boat anchor as recited in claim 11, wherein said compressible elbow is detachably attached to the fluke.

19. A modular boat anchor as recited in claim 11, wherein said compressible elbow is detachably attached to the shank.

20. A modular boat anchor, comprising:

a shank having an attachment stem and a coupling arm, said attachment stem having a link end and a stem coupling end, said coupling arm having a pivot end and an arm coupling end, said stem coupling end having at least one stem aperture, said arm coupling end having at least one arm aperture, and said pivot end having a pivot aperture;

coupling means for coupling said attachment stem with said coupling arm at said stem aperture of said attachment stem and at said arm aperture of said coupling arm;

a fluke configured to be embedded in a water floor to prevent a water craft from drifting away from a determined area, said fluke being configured to be detachably coupled with said pivot end of said shank, said fluke having a mount with a hinge aperture;

a pivot fastener positioned in said pivot aperture of said shank and in said hinge aperture of said mount for pivotally fastening said shank together with said fluke; and a spring member having one end positioned to engage the shank and the other end positioned to engage the fluke to enable said shank and said fluke to pivot with respect to each other at said pivot fastener when sufficient pressure is applied to compress said spring member.

21. A modular boat anchor as recited in claim 20, wherein said coupling means is selected from the group consisting of a pin, a shackle, a ring, a bolt, and a nut and bolt pair.

22. A modular boat anchor as recited in claim 20, wherein said fluke has a mount configured to receive said pivot end of said coupling arm and wherein said hinge aperture is located in said mount.

23. A modular boat anchor as recited in claim 20, wherein said fluke means comprise a plough-shape fluke.

24. A modular boat anchor as recited in claim 20, wherein said pivot fastener is selected from the group consisting of a pin, a bolt, a bolt and a nut, a ring, and a shackle.

25. A modular boat anchor as recited in claim 20, wherein said spring member is selected from the group consisting of a compressible elbow and a spiral spring.

26. A modular boat anchor as recited in claim 20, wherein said spring member is a compressible elbow which is not resilient.

27. A modular boat anchor as recited in claim 20, wherein said spring member is a compressible elbow which is resilient.

28. A modular boat anchor as recited in claim 20, wherein said spring member is detachably attached to the fluke.

29. A modular boat anchor as recited in claim 20, wherein said spring member is detachably attached to the pivot end of said coupling arm.

30. A kit for storing and transporting a boat anchor, comprising:

(a) a modular anchor having modular components including a shank with a link end and a pivot end, said pivot end having a pivot aperture;

fluke means for preventing a water craft from drifting away from a determined area, said fluke means being configured for detachably coupling with said pivot end of said shank, said fluke means having a hinge aperture;

pivot means for pivotally fastening said shank with said fluke means at said pivot aperture of said shank and at said hinge aperture of said fluke means; and spring means for enabling said shank and said fluke means to pivot with respect to each other at said pivot means when sufficient pressure is applied to compress said spring means;

(b) carrying means for receiving said modular components of said modular anchor after said modular anchor is disassembled and (c) a telescopic stake for fastening a line from a boat to a watershore.

31. A kit for storing and transporting a boat anchor as recited in claim 30, wherein said kit further comprises a hammer.

32. A kit for storing and transporting a boat anchor as recited in claim 30, wherein said carrying means has a plurality of retaining means for keeping said modular components in a location within the carrying means.

33. A modular boat anchor, comprising:

a shank having an attachment stem and a coupling arm, said attachment stem having a link end and a stem coupling end, said coupling arm having a pivot end and an arm coupling end, said stem coupling end having at least one stem aperture, said arm coupling end having at least one arm aperture, and said pivot end having a pivot aperture;

coupling means for coupling said attachment stem with said coupling arm at said stem aperture of said attachment stem and at said arm aperture of said coupling arm;

fluke means for preventing a water craft from drifting away from a determined area, said fluke means being configured for detachably coupling with said pivot end of said coupling arm, said fluke means having a hinge aperture;

pivot means for pivotally fastening said shank with said fluke means together at said pivot aperture of said coupling arm and at said hinge aperture of said fluke means; and spring means for enabling said shank and said fluke means to pivot with respect to each other at said pivot means when sufficient pressure is applied to compress said spring means.

34. A modular boat anchor as recited in claim 33, wherein said coupling means is selected from the group consisting of a pin, a shackle, a ring, a bolt, and a nut and bolt pair.

35. A modular boat anchor as recited in claim 33, wherein said fluke means has a mount configured to receive said pivot end of said coupling arm and wherein said hinge aperture is located in said mount.

36. A modular boat anchor as recited in claim 33, wherein said pivot means is selected from the group consisting of a pin, a bolt, a bolt and a nut, a ring, and a shackle.

37. A modular boat anchor as recited in claim 33, wherein said spring means is selected from the group consisting of a compressible elbow and a spiral spring.

38. A modular boat anchor as recited in claim 33, wherein said spring means is a compressible elbow which is not resilient.

39. A modular boat anchor as recited in claim 33, wherein said spring means is a compressible elbow which is resilient.

40. A modular boat anchor as recited in claim 33, wherein said spring means is a detachably attached to the fluke means.

41. A modular boat anchor as recited in claim 33, wherein said spring means is a detachably attached to the shank.

* * * * *

UNITED STATES PATENT AND TRADEMARK OFFICE

CERTIFICATE OF CORRECTION

PATENT NO. : 6,119,618
DATED : September 19, 2000
INVENTOR(S) : Richard Giles

It is certified that error appears in the above-identified patent and that said Letters Patent is hereby corrected as shown below:

Column 1,
Line 54, after "away" change "form" to -- from --

Column 2,
Line 27, before "anchors" change "Modem" to -- Modern --
Line 40, after "lifted" change "form" to -- from --

Column 12, claim 16,
After "modular" insert -- boat --
Before "resiliant." insert -- not --

Signed and Sealed this

First Day of January, 2002

*Attest:*

*Attesting Officer*

JAMES E. ROGAN
*Director of the United States Patent and Trademark Office*